US012404686B2

(12) United States Patent
Mikic

(10) Patent No.: US 12,404,686 B2
(45) Date of Patent: Sep. 2, 2025

(54) SCAFFOLDING CROSSBAR, SCAFFOLDING AND METHOD FOR CONSTRUCTING SCAFFOLDING

(71) Applicant: PERI SE, Weissenhorn (DE)

(72) Inventor: Erzad Mikic, Karlsruhe (DE)

(73) Assignee: PERI SE, Weissenhorn (DE)

( * ) Notice: Subject to any disclaimer, the term of this patent is extended or adjusted under 35 U.S.C. 154(b) by 412 days.

(21) Appl. No.: 16/647,861

(22) PCT Filed: Sep. 12, 2018

(86) PCT No.: PCT/DE2018/100774
§ 371 (c)(1),
(2) Date: Mar. 16, 2020

(87) PCT Pub. No.: WO2019/052604
PCT Pub. Date: Mar. 21, 2019

(65) Prior Publication Data

US 2020/0217090 A1 Jul. 9, 2020

(30) Foreign Application Priority Data

Sep. 14, 2017 (DE) ..... 10 2017 216 255.4

(51) Int. Cl.
*E04G 5/16* (2006.01)
*E04G 1/04* (2006.01)
*E04G 5/00* (2006.01)

(52) U.S. Cl.
CPC ..... *E04G 5/16* (2013.01); *E04G 1/04* (2013.01); *E04G 5/007* (2013.01)

(58) Field of Classification Search
CPC ..... E04G 5/16; E04G 5/007; E04G 5/001; E04G 5/067; E04G 1/04; E04G 1/20;
(Continued)

(56) References Cited

U.S. PATENT DOCUMENTS 1,330,290 A * 2/1920 Westman ..... E04G 11/48 249/210
1,498,665 A * 6/1924 MacIvor ..... E04G 11/48 249/210

(Continued)

FOREIGN PATENT DOCUMENTS

DE 2910467 10/1979
DE 8117020 U 11/1981

(Continued)

OTHER PUBLICATIONS

PERI GmbH: PERI UP Rosett Stützturm, Aufbau- und Verwendungsanleitung für die Regelausführung. Apr. 2014. 89259 Weißenhorn, 2012. S. 1, 5, 20, 27, 28.—Firmenschrift.

*Primary Examiner* — Jessica L Laux
*Assistant Examiner* — Kathleen M. McFarland
(74) *Attorney, Agent, or Firm* — SLEMAN & LUND LLP

(57) ABSTRACT

A scaffolding crossbar having at least two, in particular at least three crossbar coupling elements at one end. The crossbar coupling elements can be designed to be the same. The crossbar coupling elements are designed preferably in the form of receiving openings. The crossbar coupling elements serve to detachably secure diagonal piece coupling elements. The scaffolding according to the invention, having a scaffolding crossbar of this type, has a diagonal scaffolding piece with a first diagonal piece coupling element at one end and a second diagonal piece coupling element at the other end. The first diagonal piece coupling element can be designed differently from the second diagonal piece coupling element, wherein the crossbar coupling elements are designed preferably for connecting both diagonal piece coupling elements. The scaffolding can thereby be designed
(Continued)

such that it is optionally partially or completely particularly torsion resistant.

12 Claims, 5 Drawing Sheets

(58) Field of Classification Search
CPC ..... E04G 1/152; E04G 11/48; E04G 7/302; E04G 7/301; E04G 17/04
See application file for complete search history.

(56) References Cited

U.S. PATENT DOCUMENTS 1,552,333 A * 9/1925 Mosher ..... E04G 5/16 52/651.1
2,018,338 A * 10/1935 Abdelnour ..... B60S 1/4003 15/250.33
2,195,906 A * 4/1940 Uecker ..... E04G 1/14 52/651.1
2,575,461 A * 11/1951 North ..... E04G 1/24 52/646
2,794,558 A * 6/1957 Miles ..... E04G 5/007 414/12
3,367,080 A * 2/1968 McClelland ..... E04G 5/16 52/645
3,409,266 A * 11/1968 Jennings ..... E04G 17/04 248/165
3,564,803 A * 2/1971 Breeze et al. ..... E04G 11/48 52/651.1
3,693,309 A * 9/1972 Kutchai ..... E04G 11/48 52/646
3,807,120 A * 4/1974 Viandon ..... E04G 5/00 52/646
3,835,612 A * 9/1974 Beziat ..... E04G 1/14 52/646
6,220,392 B1 * 4/2001 Schwoerer ..... E04G 7/305 182/186.7
6,296,077 B1 * 10/2001 Wood ..... E04G 7/307 403/49
10,059,055 B1 * 8/2018 Riffel ..... E04G 5/16
10,995,504 B1 * 5/2021 Cook ..... E04G 7/22
2002/0014371 A1 * 2/2002 Krause ..... E04G 7/304 403/49
2002/0129567 A1 * 9/2002 Olsen ..... E04H 12/185 52/651.01
2002/0141811 A1 * 10/2002 Shih ..... E04G 25/061 403/49
2003/0061779 A1 * 4/2003 Wyse ..... E04G 5/16 52/651.1
2004/0211623 A1 * 10/2004 Weston ..... E04G 5/16 182/152
2007/0274771 A1 * 11/2007 Chang ..... E04G 11/48 403/187
2008/0128205 A1 * 6/2008 Berlin ..... E04G 7/22 182/186.7
2009/0223743 A1 * 9/2009 Jejina ..... E04G 1/38 248/235
2010/0000822 A1 * 1/2010 Wall ..... E04G 1/12 182/128
2010/0071299 A1 * 3/2010 Daas ..... E04C 3/005 52/646
2011/0047910 A1 * 3/2011 Hartmann ..... E04G 11/48 52/302.1
2011/0308189 A1 * 12/2011 Daas ..... E04H 12/10 52/646
2012/0112376 A1 * 5/2012 Khoo ..... E04G 11/48 264/33
2012/0298449 A1 * 11/2012 Kreller ..... E04G 5/147 182/113
2013/0126270 A1 * 5/2013 Darby ..... E04G 5/14 256/65.01
2013/0180801 A1 * 7/2013 Vogels ..... E04G 7/02 182/113
2014/0020982 A1 * 1/2014 Hayman ..... E04G 5/007 29/428
2014/0262619 A1 * 9/2014 Bains ..... E04G 7/34 248/351
2015/0197949 A1 * 7/2015 Rosati ..... E04G 25/061 249/219.1
2015/0267422 A1 * 9/2015 Tan ..... E04G 19/003 249/188
2015/0292263 A1 * 10/2015 Hierl ..... E04G 5/007 182/128
2019/0010718 A1 * 1/2019 Ubiñana Felix ..... E04G 5/007
2019/0078340 A1 * 3/2019 Faresin ..... E04G 1/30
2019/0078341 A1 * 3/2019 Li ..... E04G 5/16
2019/0145115 A1 * 5/2019 Bacon ..... E04G 25/08 52/127.2
2020/0002954 A1 * 1/2020 Carmody ..... E04G 1/24
2020/0284061 A1 * 9/2020 Pezzola ..... E04G 23/04
2021/0054638 A1 * 2/2021 Steck ..... E04G 1/14
2021/0062580 A1 * 3/2021 Smith ..... E04G 1/20
2021/0254351 A1 * 8/2021 Tubbs ..... E04G 5/14

FOREIGN PATENT DOCUMENTS

DE 8117020 U1 11/1981
DE 3600245 7/1986
DE 102016109972 11/2017
ES 2062945 12/1994
ES 2062945 A2 12/1994
GB 2018338 10/1979
GB 2136908 9/1984
JP 56159432 12/1981
JP 2014237930 12/2014
KR 200175311 Y1 * 3/2000
KR 20010037634 A 5/2001

* cited by examiner

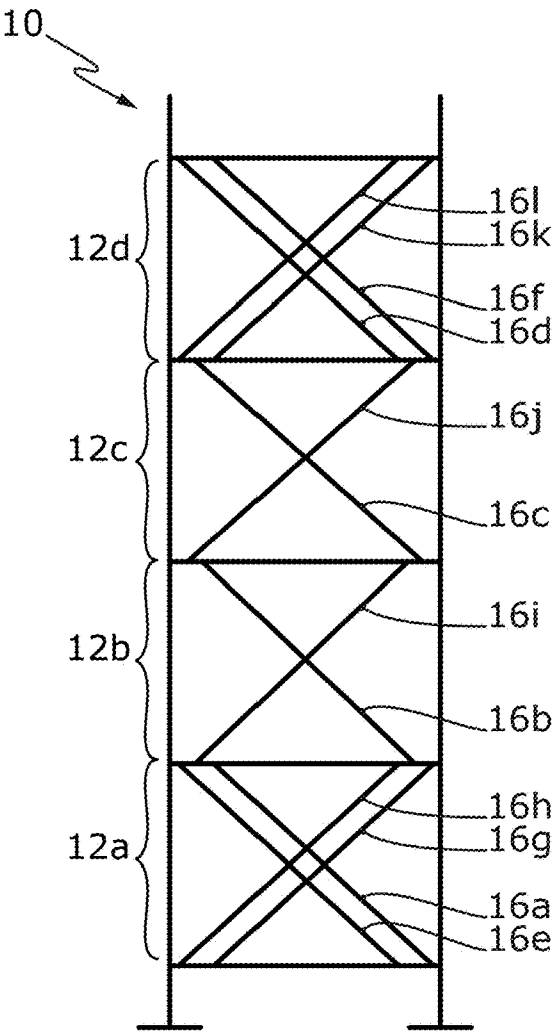
Fig. 3
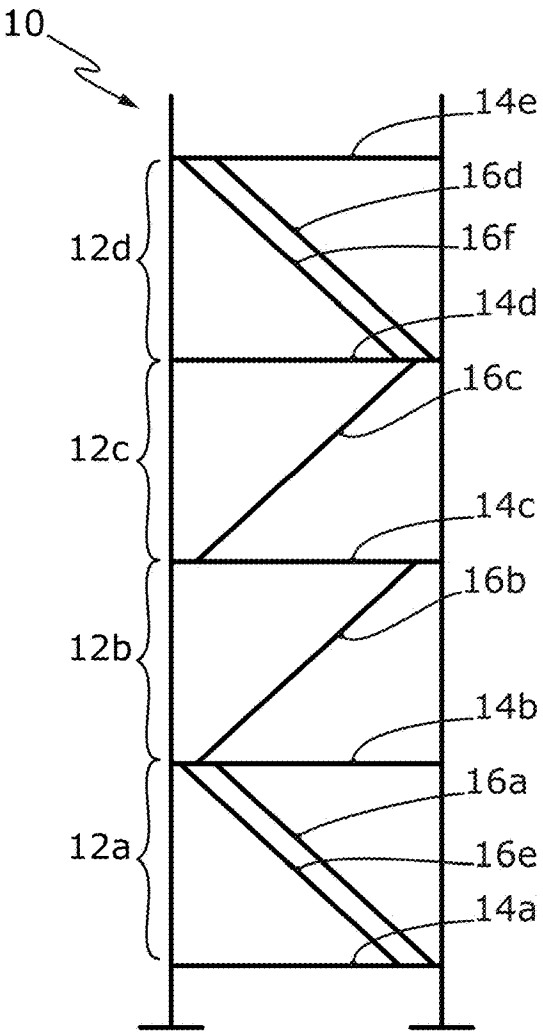
Fig. 2
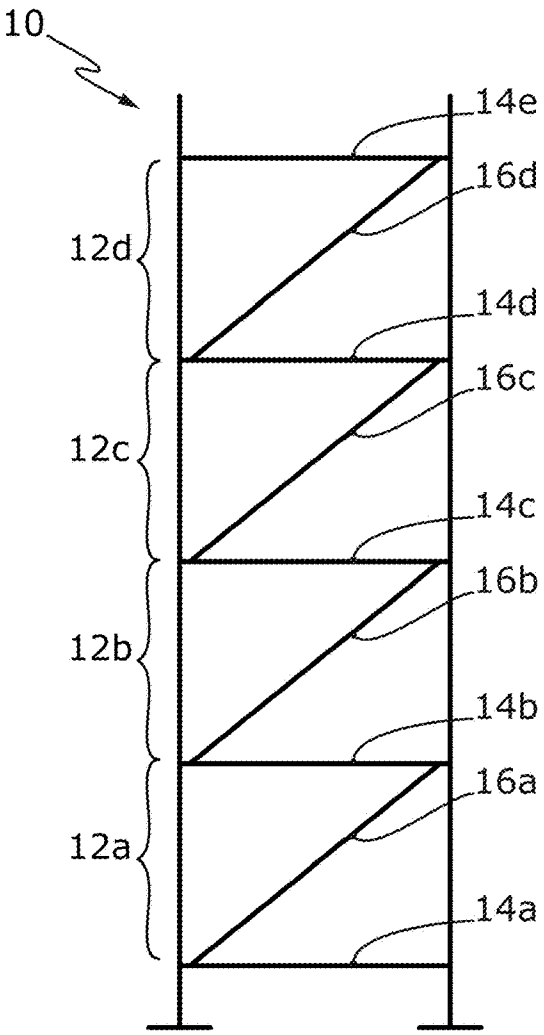
Fig. 1 - Prior Art

SCAFFOLDING CROSSBAR, SCAFFOLDING AND METHOD FOR CONSTRUCTING SCAFFOLDING

FIELD OF THE INVENTION

The invention relates to a scaffolding crossbar for the horizontal reinforcement of a scaffolding between two scaffolding posts of the scaffolding, wherein the scaffolding post comprises a first crossbar coupling part in its first longitudinal end region for connecting a diagonal coupling part of a first scaffolding diagonal scaffolding piece. The invention furthermore relates to a scaffolding with such a scaffolding crossbar and a method for constructing a scaffolding.

BACKGROUND OF THE INVENTION

It is common practice to use scaffolding posts when constructing scaffolding in lightweight construction in order to transfer vertical loads. The scaffolding posts are, either indirectly or directly, connected by means of horizontal scaffolding crossbars. These may be designed to be flexible or rigid. The scaffolding is primarily reinforced by the diagonal scaffolding piece, wherein two scaffolding crossbars are connected with a single diagonal scaffolding piece. A unit consisting of two scaffolding crossbars that are vertically arranged above each other and that are connected with a diagonal scaffolding piece is referred to as a "lift height." In prior art, therefore, one diagonal scaffolding piece is installed per lift height. The bracing this achieves, however, is not very significant. This limits the applications of known scaffoldings in lightweight construction.

SUMMARY OF THE INVENTION

It is therefore the object of the invention to provide a scaffolding crossbar that makes constructing a significantly better reinforced scaffolding possible and easier. It is furthermore the object of the invention to provide a scaffolding with such a scaffolding crossbar and a method for constructing a significantly better reinforced scaffolding.

The object according to the invention is solved by a scaffolding crossbar, a scaffolding, and a method.

The object according to the invention is therefore solved by a scaffolding crossbar. The scaffolding crossbar is preferably designed in the form of a modular scaffolding crossbar. The scaffolding crossbar is designed to horizontally reinforce a scaffolding between two scaffolding posts of the scaffolding. The scaffolding crossbar can, in particular, be arranged on connection plates, preferably in the form of perforated disks, of the scaffolding posts. The scaffolding crossbar extends in the direction of its longitudinal axis and comprises at its one end, i.e., in its longitudinally extending first end region, a first crossbar coupling part of a first diagonal scaffolding piece of the scaffolding. In addition, the scaffolding crossbar comprises in the same longitudinally extending end region a second crossbar coupling part for the connection of a diagonal piece coupling part of a second diagonal scaffolding piece of the scaffolding.

The second crossbar coupling part in the area of the first crossbar coupling part offers a simple way to arrange a second diagonal scaffolding piece per lift height. This significantly increases the rigidity and the load-bearing capacity of the scaffolding. It is not absolutely necessary to arrange a second diagonal scaffolding piece in every lift height. Rather, depending on the load on individual scaffolding parts, a second diagonal scaffolding piece may be arranged or not when the scaffolding is constructed. In other words, the scaffolding may, even after it has been constructed, be reinforced with a further diagonal scaffolding piece at particularly load-bearing points without having to significantly increase the total number of the scaffolding components or having to use a scaffolding generally designed for higher loads.

The scaffolding crossbar may comprise a third scaffolding coupling part in its first longitudinal end region for connecting a diagonal piece coupling part of a third diagonal scaffolding piece of the scaffolding. The third crossbar coupling part therefore makes it possible to further reinforce a lift height of a scaffolding by means of a third diagonal scaffolding piece. In doing so, the scaffolding is able to bear particular loads in some areas.

At least two crossbar coupling parts (30*a*-30*c*) may be arranged on the same horizontal plane, and preferably all crossbar coupling parts (30*a*-30*c*) may be arranged on the same horizontal plane.

To simplify the connection of the diagonal scaffolding piece, a plurality of crossbar coupling parts, preferably all crossbar coupling parts, may be formed equally.

If at least three crossbar coupling parts are arranged or formed on the scaffolding post, the part in the center of the three crossbar coupling parts is preferably evenly spaced from its two adjacent crossbar coupling parts.

A crossbar coupling part may have the form of a projection. Preferably, a plurality, preferably all, crossbar coupling parts have the form of a projection.

In a particularly preferred embodiment of the invention, a crossbar coupling part has the form of a through-recess. A diagonal piece coupling part may, in this case, have the form of a projection, which can, at least partially, be placed into the through-recess. In a further preferred embodiment, a plurality, preferably all, crossbar coupling parts have the form of a through-recess.

To be able to not have to pay a lot of attention to the orientation of the scaffolding crossbar when constructing the scaffolding, the scaffolding crossbar is preferably formed symmetrically to a symmetry plane. The symmetry plane may run vertically to the longitudinal axis of the scaffolding crossbar.

The object according to the invention is furthermore solved by a scaffolding with a first scaffolding crossbar as described above, a first diagonal scaffolding piece, whose diagonal piece coupling part is connected with the first crossbar coupling part of the first scaffolding crossbar, and a second diagonal scaffolding piece, whose diagonal piece coupling part is connected with the second crossbar coupling part of the first scaffolding crossbar. The scaffolding is preferably a modular scaffolding.

The scaffolding may furthermore comprise the following:

a. A first scaffolding post and a second scaffolding post, wherein the first scaffolding crossbar connects, either indirectly or directly, the first scaffolding post with the second scaffolding post;

b. a previously described second scaffolding crossbar, which, either indirectly or directly, connects the first scaffolding post with the second scaffolding post;

wherein the first diagonal scaffolding piece comprises, at one end, the first diagonal piece coupling part and, at the other end, a second diagonal piece coupling part, wherein the second diagonal piece coupling part is connected to a crossbar coupling part of the second scaffolding crossbar;

and wherein the second diagonal scaffolding piece comprises, at one end, the first diagonal piece coupling part and, at the other end, a second diagonal piece coupling part, wherein the second diagonal piece coupling part is connected with a crossbar coupling part of the second scaffolding crossbar.

The scaffolding may comprise a third diagonal scaffolding piece, which, at one end, comprises a first diagonal piece coupling part and, at the other end, a second diagonal piece coupling part, wherein the third diagonal scaffolding piece connects the two scaffolding crossbars. This makes the lift height of a scaffolding particularly well reinforced.

The first diagonal piece coupling part of the third diagonal scaffolding piece may be connected with a crossbar coupling part of the first scaffolding crossbar, and the second diagonal piece coupling part of the third diagonal scaffolding piece may be connected with a crossbar coupling part of the second scaffolding.

To be able to arrange the first diagonal scaffolding piece to the scaffolding crossbars in a particularly easy and fast but still reliable manner, the first diagonal piece coupling part is preferably formed so that it does not fully penetrate the scaffolding crossbar. The second diagonal piece coupling part of the first diagonal scaffolding piece is preferably formed so that it fully penetrates the scaffolding crossbar.

It is furthermore preferred that the first diagonal piece coupling part has the form of a rigid hook. The second diagonal piece coupling part preferably comprises a pin. The pin may be a movable element to ensure the engagement of the pin. This allows for a fast hooking into the first diagonal piece coupling part and a reliable arrangement of the diagonal scaffolding piece with the, in particular, secured pin.

The first diagonal scaffolding piece is preferably the same as the second diagonal scaffolding piece and in particular the same as the third diagonal scaffolding piece.

The object according to the invention is furthermore solved by a method for constructing a scaffolding, in particular a scaffolding as described above, with the following method steps:

A) Fastening of a first diagonal scaffolding piece between a first scaffolding crossbar and a second scaffolding crossbar;

B) Fastening of a first diagonal scaffolding piece between the first scaffolding crossbar and the second scaffolding crossbar.

The method may furthermore comprise the following method step:

C) Fastening of a third diagonal scaffolding piece between the first scaffolding crossbar and the second scaffolding crossbar.

Prior to, after and/or between the method steps A), B) and/or C), a further process step or further process steps may be performed.

In the present invention, the terms "top," "bottom," "vertical," "horizontal," etc. refer to the scaffolding in its assembled state.

BRIEF DESCRIPTION OF THE DRAWINGS

Further features and advantages of the invention are described in the following detailed description of several exemplary embodiments of the invention and the claims as well as the figures of the drawing, which shows details that are essential to the invention. The different features may be realized in variants of the invention either individually or in any combination. The features shown in the drawing are shown in such a way that the particulars of the invention can be clearly demonstrated.

FIG. 1 shows a schematic side view of a scaffolding according to prior art with a diagonal scaffolding piece between two scaffolding crossbars;

FIG. 2 shows a schematic side view of a scaffolding, wherein two diagonal scaffolding pieces are arranged between two scaffolding crossbars each at the lowermost lift height and the top lift height;

FIG. 3 shows a schematic side view of a scaffolding, wherein four diagonal scaffolding pieces are arranged between two scaffolding crossbars each at the lowest lift height and at the highest lift height and wherein two diagonal scaffolding pieces are arranged between two scaffolding crossbars each in the lift height between them;

FIG. 4*b* shows an enlarged side view of the scaffolding according to the dot-dashed area in FIG. 4*a*, wherein FIG. 4*b* shows two crossbar coupling parts formed on the scaffolding crossbar;

FIG. 4*c* shows an enlarged isometric view of the scaffolding according to the dotted area in FIG. 4*a*, wherein FIG. 4*c* shows the pending arrangement of a third diagonal scaffolding piece;

DETAILED DESCRIPTION

FIG. 1 shows a scaffolding 10 according to prior art. The scaffolding 10 comprises a plurality of lift heights 12*a*, 12*b*, 12*c*, 12*d*. The lift heights 12*a*-12*d* each comprise two scaffolding crossbars 14*a*, 14*b*, 14*c*, 14*d*, 14*e*. A diagonal scaffolding piece 16*a*, 16*b*, 16*c*, 16*d* is arranged between two scaffolding crossbars 14*a*-14*e* each. One diagonal scaffolding piece 16*a*-16*d* is therefore provided for each lift height 12*a*-12*d*. For many applications, however, the scaffolding 10 is not reinforced enough. The object of the present invention is therefore to provide a scaffolding 10 that is significantly more reinforced.

FIG. 2 shows a scaffolding 10 according to the invention with lift heights 12*a*-12*d* and scaffolding crossbars 14*a*-14*e*. The scaffolding 10 comprises, however, diagonal scaffolding pieces 16*e*, 16*f* in addition to the diagonal scaffolding pieces 16*a*-16*d*. The lift heights 12*a* and 12*d* are particularly rigid due to the additional diagonal scaffolding pieces 16*e*, 16*f*. It was found that the stability of the lowermost lift heights is what matters most when increasing the overall stability of the scaffolding 10. The scaffolding 10 according to FIG. 2 is thus formed so that it is particularly effective in bearing high loads because only the critical areas in the form of the lift heights 12*a* and 12*d* are reinforced by at least one additional diagonal scaffolding piece 16*e*, 16*f*.

FIG. 3 shows an embodiment of a scaffolding 10, which is even more reinforced than the scaffolding 10 in FIG. 2. The scaffolding 10 in FIG. 3 comprises, in each lift height 12*a*-12*d*, at least two diagonal scaffolding pieces 16*a*-16*f*, 16*g*, 16*h*, 16*i*, 16*j*, 16*k*, 16*l*. The diagonal scaffolding pieces 16*a*-161 are therefore preferably arranged above the cross so that they are offset against each other. The lowermost lift height 12*a* and the top lift height 12*d* may be, as shown, especially reinforced.

Figure 4B:
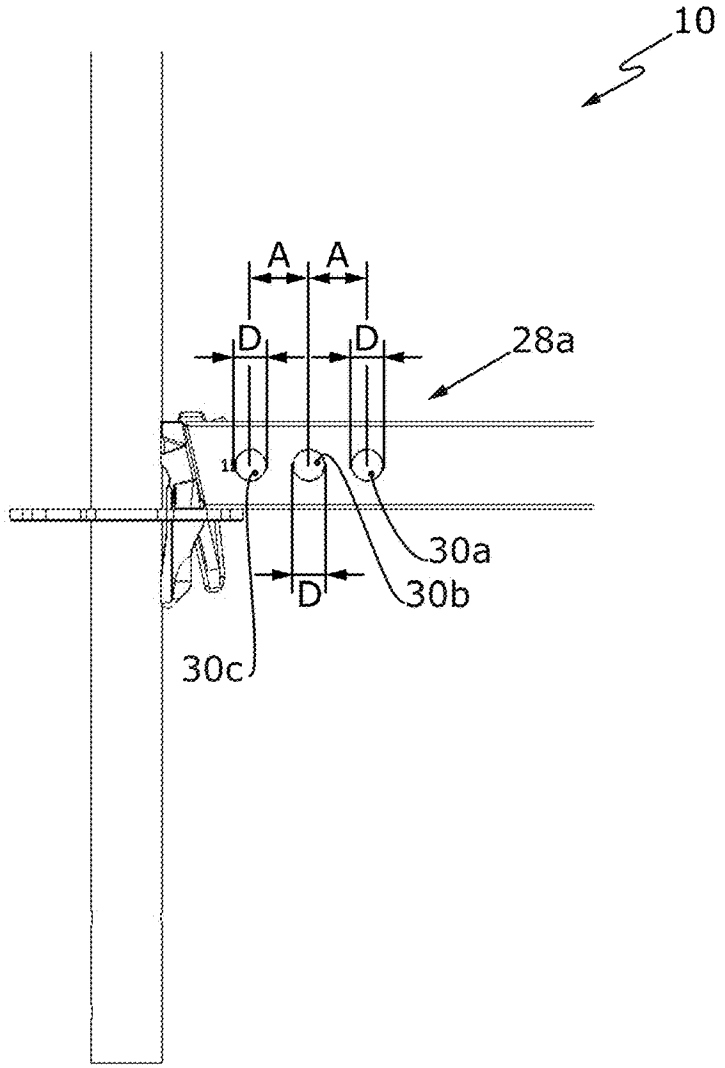
Figure 4A:
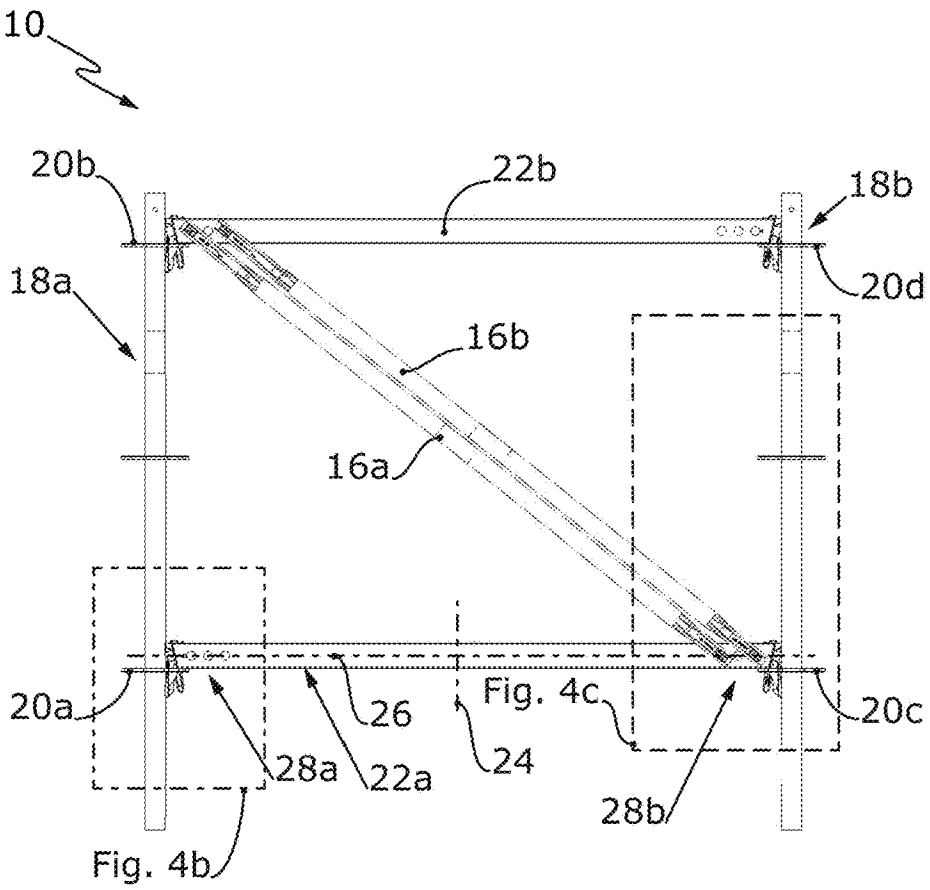
FIG. 4*a* shows a side view of a scaffolding with two scaffolding posts, two scaffolding crossbars connecting the scaffolding posts and two diagonal scaffolding pieces reinforcing the scaffolding crossbars.

FIG. 4*a* shows a part of a scaffolding 10 with vertically oriented scaffolding posts 18*a*, 18*b*. The scaffolding posts 18*a*, 18*b* each comprise connection plates 20*a*, 20*b*, 20*c*, 20*d*, here in the form of perforated plates, especially in the form of rosettes. Scaffolding crossbars 22*a*, 22*b* are arranged on, in particular inserted into, the connection plates 20*a*, 20*b*. The front sides scaffolding crossbars 22*a*, 22*b* may lie against the scaffolding posts 18*a*, 18*b* to create a particularly stable embodiment of the scaffolding 10.

The scaffolding crossbar 22*a* is formed so that it is symmetrical to a symmetry plane 24. The symmetry plane 24 runs vertical to the longitudinal axis 26 of the scaffolding crossbar 22*a*.

The scaffolding crossbars 22*a*, 22*b* are designed to be the same.

Diagonal scaffolding pieces 16*a*, 16*b* are arranged between the scaffolding crossbars 22*a*, 22*b*. Seen in the direction of the longitudinal axis 26, the scaffolding crossbar 22*a* has a first end region 28*a* and a second end region 28*b*. A plurality of diagonal scaffolding pieces 16*a*, 16*b* can be arranged on at least one end region 28*a*, 28*b*.

FIG. 4*b* shows the scaffolding 10 according to the area in the dot-dashed frame in FIG. 4*a*. FIG. 4*b* shows that the scaffolding crossbar 22*a* comprises a first crossbar coupling part 30*a*, a second crossbar coupling part 30*b* and a third crossbar coupling part 30*c* in the first end region 28*a*. The crossbar coupling parts 30*a*-30*c* are each configured in the form of a through-recess. At least one through-recess may be formed by both side walls of the scaffolding crossbar 22*a*. Preferably, a plurality of through-recesses, more preferably all through-recesses, are formed by both side walls of the scaffolding crossbar 22*a*. At least one through-recess, preferably a plurality of through-recesses, in particular all through-recesses, can have a same diameter D, in particular of 22 mm±20 mm, preferably of 22 mm±10 mm, particularly preferably of 22 mm±5 mm. The crossbar coupling parts 30*a*-30*c* may have the same distance A from each other. The distance A is preferably 40 mm±20 mm, in particular 40 mm±10 mm, most preferably 40 mm±5 mm.

Figure 4D:
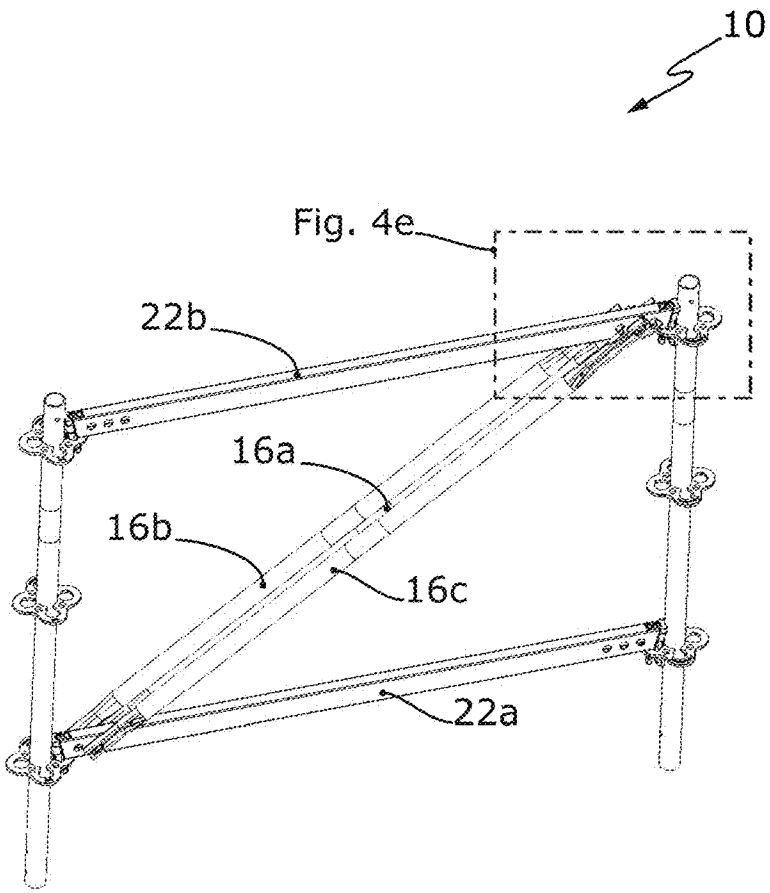
FIG. 4*d* shows an isometric view of the scaffolding according to FIG. 4*c* after the third diagonal scaffolding piece has been arranged.
Figure 4C:
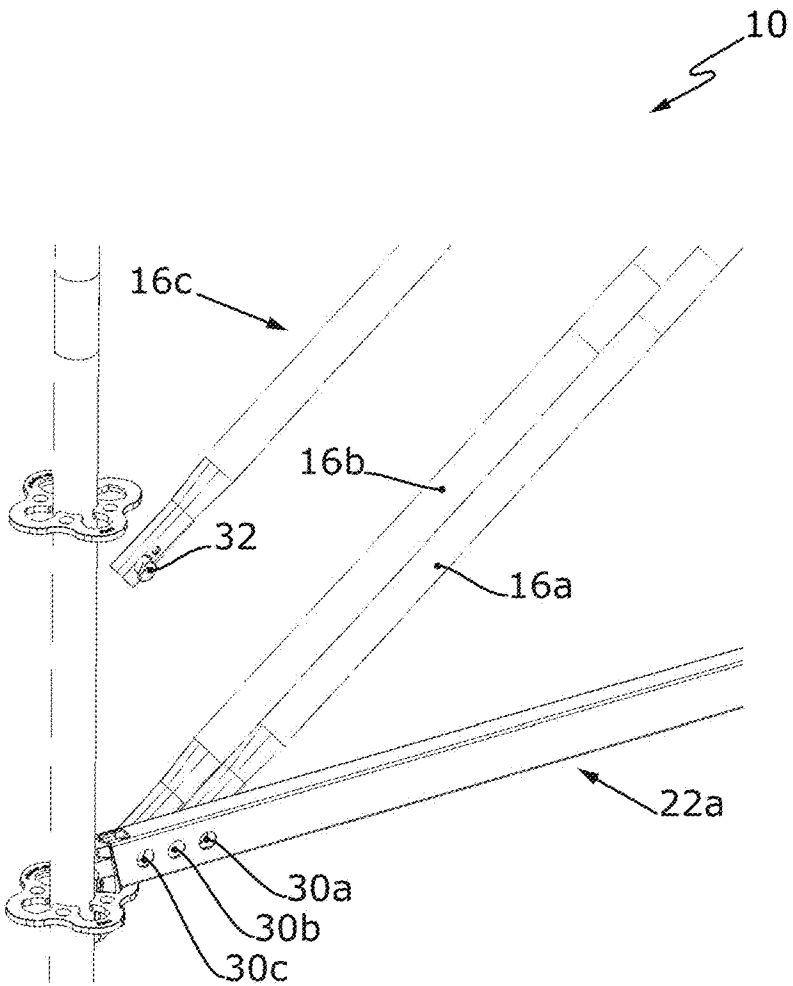

FIG. 4*c* shows the scaffolding 10 according to the area in the dashed frame in FIG. 4*a*. According to FIG. 4*c*, two diagonal scaffolding pieces 16*a*, 16*b* are already fastened to the scaffolding crossbar 22*a*. A third diagonal scaffolding piece 16*c* is to be arranged on the scaffolding crossbar 22*a* in addition. The third diagonal scaffolding piece 16*c* comprises a first diagonal piece coupling part 32. The first diagonal piece coupling part 32 is configured in the form of a hook, which is preferably formed to engage with a single side wall of the scaffolding crossbar 22*a* of a crossbar coupling part 30*a*, 30*b*, 30*c*.

FIG. 4*d* shows the scaffolding 10 with three diagonal scaffolding pieces 16*a*, 16*b*, 16*c* between the scaffolding crossbars 22*a*, 22*b*. The diagonal scaffolding pieces 16*a*-16*c* are preferably arranged on both sides of the scaffolding crossbar 22*a*, 22*b*; in the present case, the diagonal scaffolding pieces 16*a*, 16*b* are arranged on one side of the scaffolding crossbars 22*a*, 22*b*, and the diagonal scaffolding piece 16*c* is arranged on the other side of the scaffolding crossbars 22*a*, 22*b*.

Figure 4E:
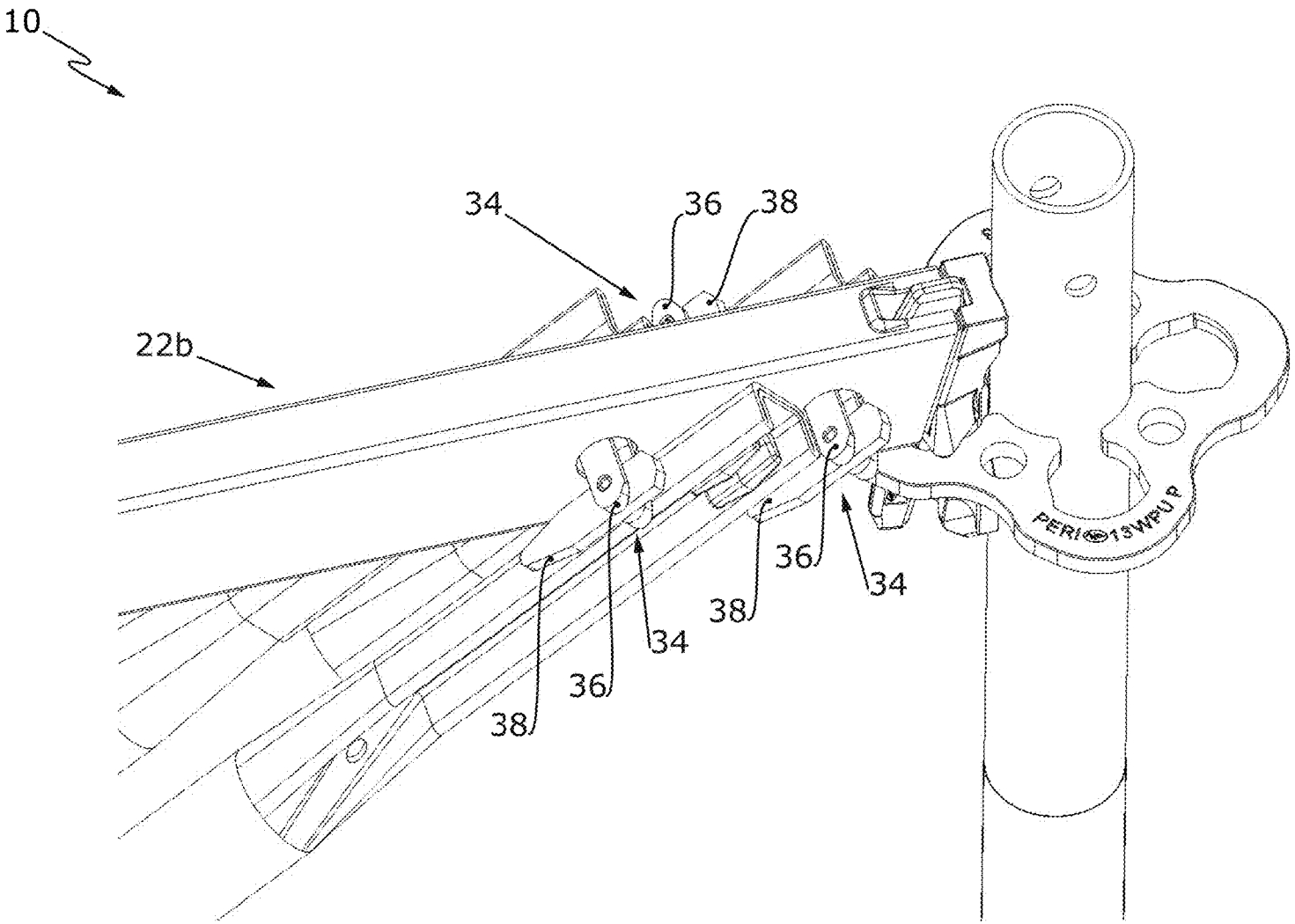
FIG. 4*e* shows an enlarged isometric partial view of the scaffolding according to the dot-dashed area in FIG. 4*d;*

FIG. 4*e* shows the scaffolding 10 according to the area in the dot-dashed frame in FIG. 4*d*. FIG. 4*e* makes clear that the scaffolding crossbar 22*b*, in particular both side walls of the scaffolding crossbar 22*b*, are penetrated by two diagonal piece coupling parts 34. The diagonal piece coupling parts 36 each have a pin, which is secured by a movable element 38.

Figure 5:
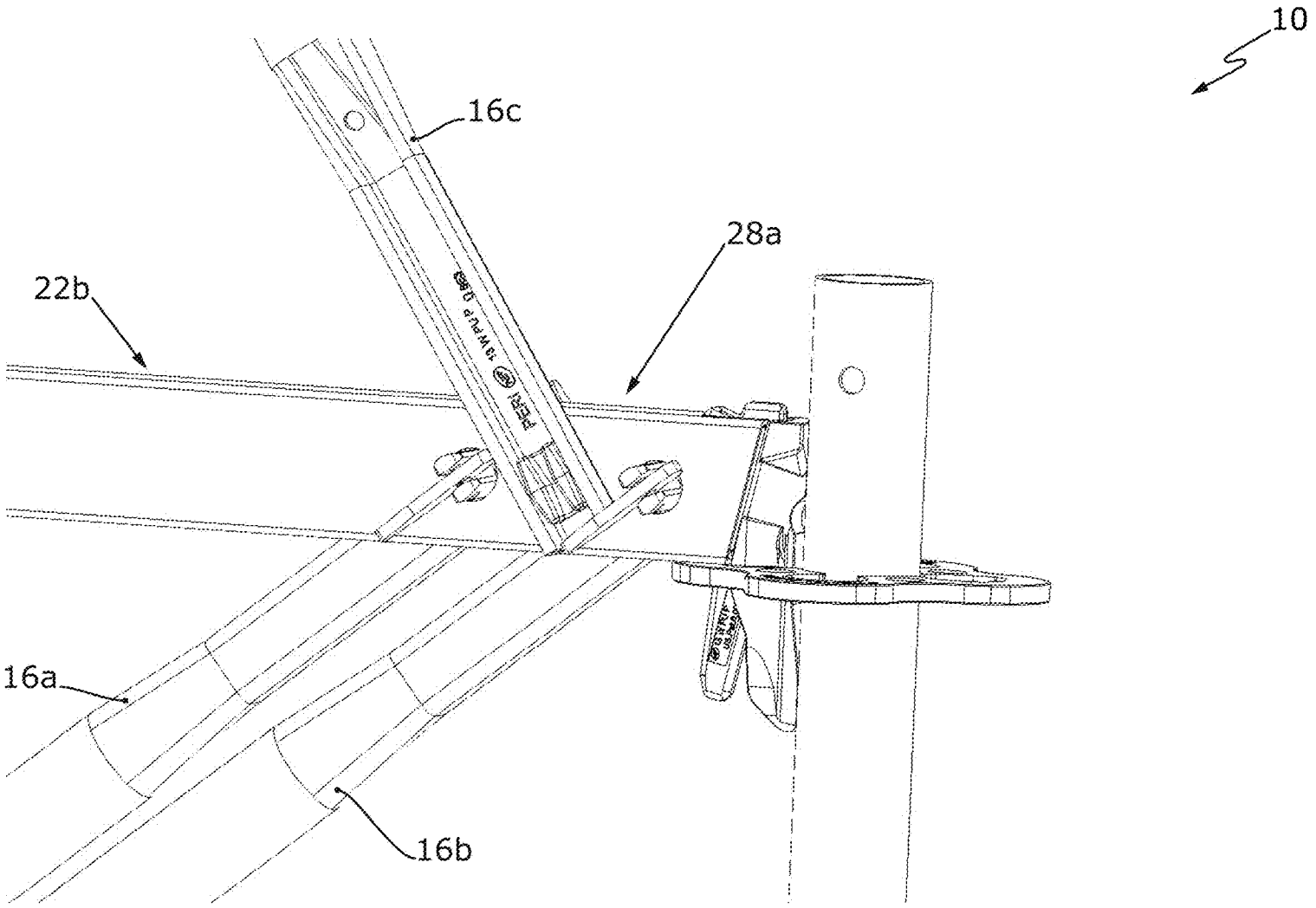
FIG. 5 shows an isometric partial view of the scaffolding according to FIG. 4*e* but with a different fastening variant of the third diagonal scaffolding piece.

FIG. 5 shows a scaffolding 10, wherein diagonal scaffolding pieces 16*a*, 16*b* are arranged parallel to each other at the first end 28*a* of the scaffolding crossbar 22*b* and extend downward. A third diagonal scaffolding piece 16*c* is arranged also at the first end 28*a* of the scaffolding crossbar 22*b*, preferably between the scaffolding crossbars 16*a*, 16*b*, and extends upward.

Combining all the figures of the drawing, the invention relates, in summary, to a scaffolding crossbar 22*a*, 22*b*, which, at one end, comprises at least two, preferably in particular three, crossbar coupling elements 30*a*-30*c*. The crossbar coupling elements 30*a*-30*c* can be designed to be the same. The crossbar coupling elements 30*a*-30*c* are preferably in the form of receiving openings. The crossbar coupling elements 30*a*-30*c* serve to detachably secure the diagonal piece coupling elements 32, 24. A scaffolding 10 according to the invention, having a scaffolding crossbar 22*a*, 22*b* of this type, has diagonal scaffolding piece 16*a*-161 with a first diagonal piece coupling element 32 at one end and a second diagonal piece coupling element 34 at the other end. The first diagonal piece coupling element 32 can be designed differently from the second diagonal piece coupling element 34, wherein the crossbar coupling elements 30*a*-30*c* are designed preferably for connecting both diagonal piece coupling elements 32, 34. The scaffolding 10 can therefore be designed such that it is optionally partially or completely torsion-resistant.

The invention claimed is:

1. A scaffolding, comprising:

a first scaffolding crossbar having a first longitudinal axis defined along a length of the first scaffolding crossbar, the first scaffolding crossbar configured for horizontal reinforcement of the scaffolding between two scaffolding posts of the scaffolding, the first scaffolding crossbar having a first crossbar coupling part in its longitudinally sided first end region for connecting a first diagonal piece coupling part of a first diagonal scaffolding piece of the scaffolding, the first scaffolding crossbar having a second crossbar coupling part in its longitudinally sided first end region for connecting a second diagonal piece coupling part of a second diagonal scaffolding piece of the scaffolding, wherein the first crossbar coupling part and the second crossbar coupling part are arranged at a first distance from one another along the longitudinal axis of the first scaffolding crossbar;

a second scaffolding crossbar having a second longitudinal axis defined along a length of the second scaffolding crossbar, the second scaffolding crossbar configured for horizontal reinforcement of the scaffolding between the two scaffolding posts of the scaffolding, the second scaffolding crossbar having a third crossbar coupling part in its longitudinally sided second end region for connecting a third diagonal piece coupling part of the first diagonal scaffolding piece of the scaffolding, the second scaffolding crossbar having a fourth crossbar coupling part in its longitudinally sided second end region for connecting a fourth diagonal piece coupling part of the second diagonal scaffolding piece of the scaffolding, wherein the third crossbar coupling part and the fourth crossbar coupling part are arranged at the first distance from one another along the second longitudinal axis of the second scaffolding crossbar, the first diagonal scaffolding piece having the first diagonal piece coupling part connected with the first crossbar coupling part of the first scaffolding crossbar and having the third diagonal piece coupling part connected with the third crossbar coupling part of the second scaffolding crossbar; and the second diagonal scaffolding piece having the second diagonal piece coupling part connected with the second crossbar coupling part of the first scaffolding crossbar and having the fourth diagonal piece coupling part connected with the fourth crossbar coupling part of the second scaffolding crossbar, wherein the first diagonal scaffolding piece and the second diagonal scaffolding piece are arranged parallel to each other at the first end region of the first scaffolding crossbar and at the second end region of the second scaffolding crossbar, are offset from each other along both the first longitudinal axis of the first scaffolding crossbar and the second longitudinal axis of the second scaffolding crossbar by the first distance, and extend downward, wherein the first diagonal piece coupling part and the second diagonal piece coupling part do not penetrate the first scaffolding crossbar and wherein the third diagonal piece coupling part and the fourth diagonal piece coupling part penetrate the second scaffolding crossbar.

2. The scaffolding according to claim 1, wherein the first scaffolding crossbar comprises an additional crossbar coupling part in its longitudinally sided first end region for connecting an additional diagonal piece coupling part of a third diagonal scaffolding piece of the scaffolding, wherein at least the three crossbar coupling parts have a same distance from their adjacent crossbar coupling part.

3. The scaffolding according to claim 1, wherein at least the first crossbar coupling part and the second crossbar coupling part are designed to be the same.

4. The scaffolding according to claim 1, wherein at least one of the first crossbar coupling part or the second crossbar coupling part:

i) is designed in the form of a through-recess, or ii) is designed in the form of a projection.

5. The scaffolding according to claim 1, wherein the first scaffolding crossbar is formed symmetrical to a symmetry plane that runs vertical to the longitudinal axis of the first scaffolding crossbar.

6. The scaffolding according to claim 1, further comprising:

a first scaffolding post of the two scaffolding posts and a second scaffolding post of the two scaffolding posts;

the first scaffolding crossbar, which, either indirectly or directly, connects the first scaffolding post with the second scaffolding post; and a second scaffolding crossbar, which, either indirectly or directly, connects the first scaffolding post with the second scaffolding post.

7. The scaffolding according to claim 6, wherein the scaffolding comprises a third diagonal scaffolding piece, which, at one end, comprises a fifth diagonal piece coupling part and, at the other end, a sixth diagonal piece coupling part, wherein the fifth diagonal piece coupling part is connected with the first crossbar coupling part of the first scaffolding crossbar and the sixth diagonal piece coupling part is connected with the crossbar coupling part of the second scaffolding crossbar.

8. The scaffolding according to claim 6, wherein the first and second diagonal piece coupling parts are designed in the form of a stiff hook and wherein the third and fourth diagonal piece coupling parts comprises a pin, with a movable element for securing the engagement of the pin.

9. A method for constructing a scaffolding according to claim 6, comprising:

arranging the first diagonal scaffolding piece between the first scaffolding crossbar and the second scaffolding crossbar;

arranging the second diagonal scaffolding piece between the first scaffolding crossbar and the second scaffolding crossbar.

10. The method according to claim 9, wherein the method comprises:

arranging a third diagonal scaffolding piece between the first scaffolding crossbar and the second scaffolding crossbar.

11. A scaffolding, comprising:

a first scaffolding crossbar having a first longitudinal axis defined along a length of the first scaffolding crossbar, the first scaffolding crossbar having a first crossbar coupling part at a first end of the first scaffolding crossbar and having a second crossbar coupling part at the first end of the first scaffolding crossbar, wherein the first crossbar coupling part and the second crossbar coupling part are arranged at a first distance from one another along the longitudinal axis of the first scaffolding crossbar;

a second scaffolding crossbar having a second longitudinal axis defined along a length of the second scaffolding crossbar, the second scaffolding crossbar having a third crossbar coupling part at a second end of the second scaffolding crossbar and having a fourth crossbar coupling part at the second end of the second scaffolding crossbar, wherein the third crossbar coupling part and the fourth crossbar coupling part are arranged at the first distance from one another along the second longitudinal axis of the second scaffolding crossbar a first diagonal scaffolding piece having a first diagonal scaffolding piece coupling part connected with the first crossbar coupling part of the first scaffolding crossbar and having a third diagonal scaffolding piece coupling part connected with the third crossbar coupling part of the second scaffolding crossbar; and a second diagonal scaffolding piece having a second diagonal scaffolding piece coupling part connected with the second crossbar coupling part of the first scaffolding crossbar and having a fourth diagonal scaffolding piece coupling part connected with the fourth crossbar coupling part of the second scaffolding crossbar, wherein the first diagonal scaffolding piece and the second diagonal scaffolding piece are arranged parallel to each other at both the first end region of the first scaffolding crossbar and the second end region of the second scaffolding crossbar and are offset from each other along both the first longitudinal axis of the first scaffolding crossbar and the second longitudinal axis of the second scaffolding crossbar by the first distance, wherein the first diagonal piece coupling part and the second diagonal piece coupling part do not penetrate the first scaffolding crossbar and wherein the third diagonal piece coupling part and the fourth diagonal piece coupling part penetrate the second scaffolding crossbar.

12. The scaffolding according to claim 11, wherein the first diagonal scaffolding piece and the second diagonal scaffolding piece extend downward.

* * * * *